US007014040B2

(12) United States Patent
Anderson et al.

(10) Patent No.: US 7,014,040 B2
(45) Date of Patent: Mar. 21, 2006

(54) GOLF BAG THROAT STRUCTURE

(75) Inventors: Douglas W. Anderson, Phoenix, AZ (US); David L. Petersen, Peoria, AZ (US); Roger J. Kleber, Glendale, AZ (US); Derek W. Haines, Cave Creek, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 104 days.

(21) Appl. No.: 10/831,602

(22) Filed: Apr. 23, 2004

(65) Prior Publication Data

US 2005/0236288 A1 Oct. 27, 2005

(51) Int. Cl.
*A63B 55/00* (2006.01)

(52) U.S. Cl. ..... 206/315.6; 206/315.3; 211/70.2

(58) Field of Classification Search ..... 206/315.3, 206/315.6; D3/320; 280/DIG. 6
See application file for complete search history.

(56) References Cited

U.S. PATENT DOCUMENTS

| | | | | |
|---|---|---|---|---|
| 4,596,328 A | | 6/1986 | Solheim | |
| 4,796,752 A | * | 1/1989 | Reimers | 206/315.3 |
| D323,741 S | | 2/1992 | Antonious | |
| 5,099,990 A | | 3/1992 | Antonious | |
| 5,103,974 A | | 4/1992 | Antonious | |
| D327,168 S | | 6/1992 | Antonious | |
| 5,226,533 A | | 7/1993 | Antonious | |
| 5,816,397 A | * | 10/1998 | Pratt | 206/315.6 |
| 5,911,322 A | * | 6/1999 | Lombardo et al. | 206/315.3 |
| D431,111 S | * | 9/2000 | Ryan | D3/320 |
| D442,783 S | * | 5/2001 | Pratt et al. | D3/320 |
| 6,269,947 B1 | * | 8/2001 | Chang | 206/315.6 |
| 6,564,936 B1 | * | 5/2003 | Campbell | 206/315.6 |
| D478,422 S | * | 8/2003 | Chen | D3/320 |
| 6,726,009 B1 | * | 4/2004 | Larson et al. | 206/315.6 |
| 2004/0074792 A1 | * | 4/2004 | Pratt et al. | 206/315.6 |

* cited by examiner

*Primary Examiner*—Sue A. Weaver
(74) *Attorney, Agent, or Firm*—Darrell F. Marquette

(57) ABSTRACT

In a golf bag that includes a body with a top end and a bottom end, a throat structure is mounted in the top end of the body. The throat structure has a substantially ring shaped outer wall and a raised inner wall extending transversely of the body top end with its opposite ends connected to the outer wall. A first plurality of three divider walls extends between the inner and outer walls to define a first plurality of four individual compartments located along a back portion of the throat structure. Each compartment of the first plurality of individual compartments is adapted for receiving one wood-type golf club. A raised well is located along a front portion of the throat structure opposite the first plurality of individual compartments. The raised well is adapted for receiving a golf putter. A second plurality of two divider walls extends between the raised inner wall and the raised well to define a second plurality of three individual compartments located between the front and back portions of the throat structure. Each compartment of the second plurality of individual compartments is adapted for receiving a plurality of iron-type golf clubs.

9 Claims, 5 Drawing Sheets

GOLF BAG THROAT STRUCTURE

BACKGROUND OF THE INVENTION

This invention relates generally to golf equipment and, in particular, to a golf bag throat structure.

Throat structures have been used in golf bags to separate golf clubs stored therein into groups. These throat structures typically include two or three divider bars that extend transversely across an open top end of a golf bag and divide this open top end into separate compartments for separating golf clubs. Sometimes, the divider bars are joined to each other by additional bars.

U.S. Pat. No. 4,596,328 to J. A. Solheim discloses a throat structure mounted in an open top end of a golf bag. The throat structure includes a divider which separates the open top end of the golf bag into four compartments. The divider includes a pair of divider bars which are connected to each other near their centers by a rib. The divider bars are angled away from each other as they extend outwardly from the rib. This arrangement of the divider bars causes golf clubs, which are inserted into the golf bag through the throat structure, to gather and remain in outer corners of two of the compartments and in an inner corner of one compartment.

U.S. Pat. No. 5,099,990 to A. J. Antonious discloses an insert for use in an open top end of a golf bag. In one embodiment, the insert includes a primary compartment surrounded by a plurality of secondary compartments. The primary compartment extends above the secondary compartments a sufficient distance so that golf clubs stored in the primary compartment are protected from golf clubs stored in the secondary compartments. In another embodiment, the insert has a primary compartment which is eccentrically located with respect to the secondary compartments.

SUMMARY OF THE INVENTION

The present invention provides a throat structure for a golf bag wherein the golf bag includes a body with a top end and a bottom end. The throat structure is mounted in the top end of the body and includes a substantially ring-shaped outer wall. A raised inner wall extends transversely of the body top end and has its opposite ends connected to the outer wall. A first plurality of divider walls extends between the inner and outer walls to define a first plurality of individual compartments located along a back portion of the throat structure each of which is adapted for receiving one wood-type golf club. A raised well is located along a front portion of the throat structure opposite the first plurality of individual compartments. The raised well is adapted for receiving a golf putter. A second plurality of divider walls extends between the raised inner wall and the raised well to define a second plurality of individual compartments located between the front and back portions of the throat structure each of which is adapted for receiving a plurality of iron-type golf clubs.

In the preferred embodiment of the throat structure, the first plurality of divider walls comprises three divider walls and the first plurality of individual compartments comprises four individual compartments. Also, the second plurality of divider walls comprises two divider walls and the second plurality of individual compartments comprises three individual compartments. The raised inner wall has a height sufficient to prevent the iron-type golf clubs received in the second plurality of individual compartments from contacting the wood-type golf clubs received in the first plurality of individual compartments. The raised well has a height sufficient to prevent the iron-type golf clubs received in the second plurality of individual compartments from contacting the golf putter received in the raised well. The raised well includes a substantially V-shaped trough in a front wall thereof for aligning the golf putter received in the raised well generally centrally between opposite side walls of the raised well.

DESCRIPTION OF THE PREFERRED EMBODIMENT

Figure 1:
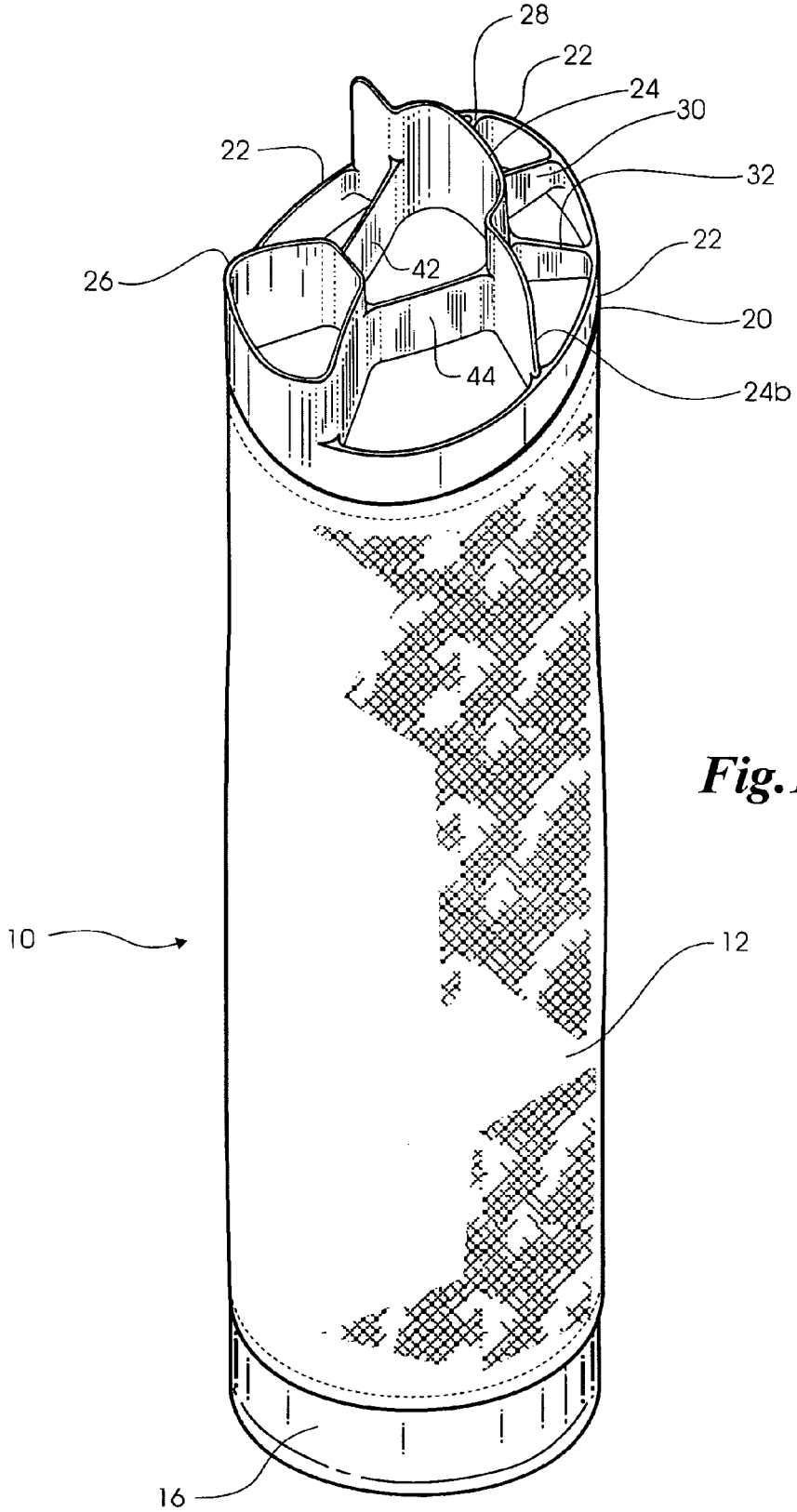
FIG. 1 is a perspective view of a golf bag incorporating a throat structure according to the present invention.
Figure 2:
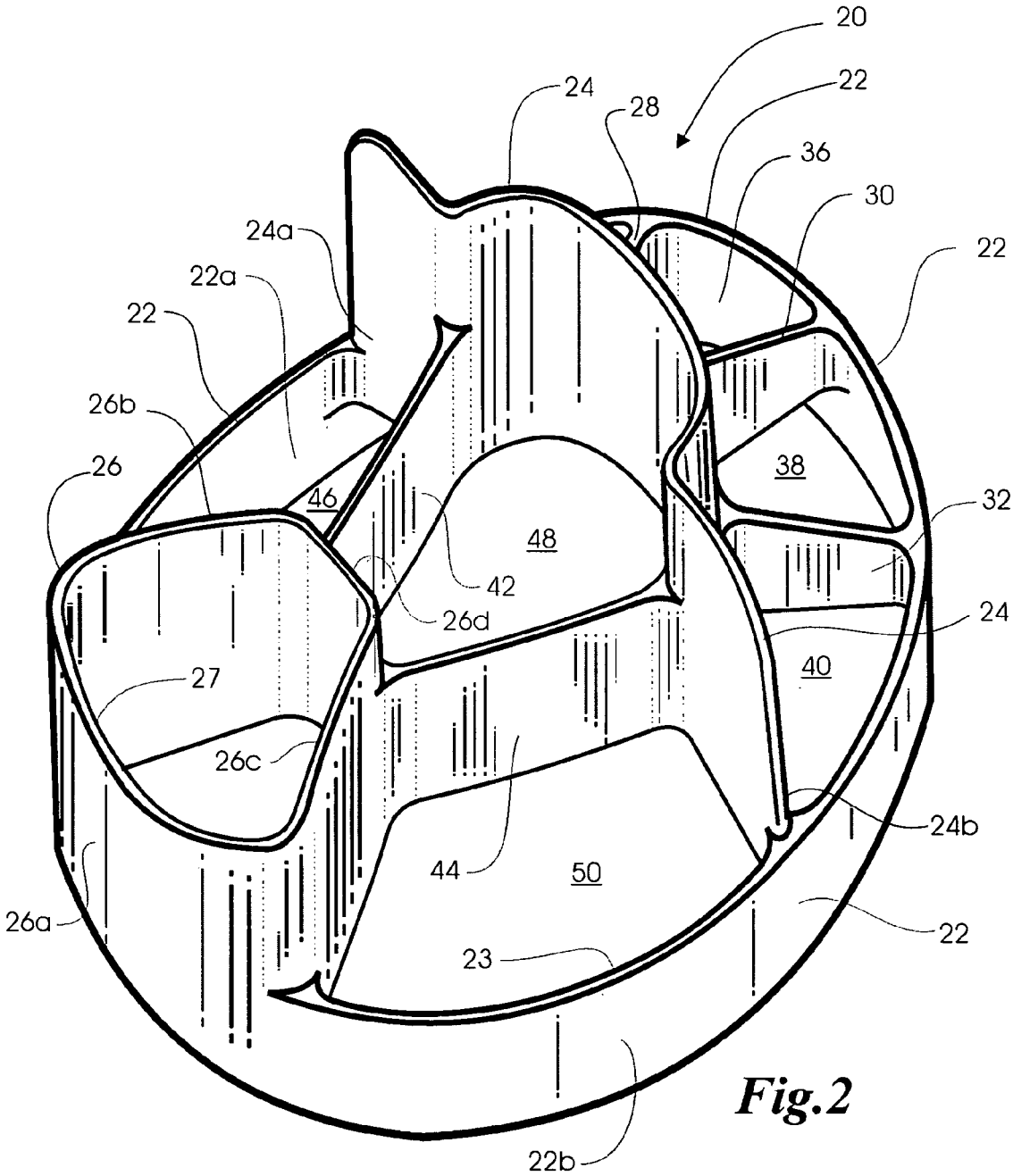
FIG. 2 is a perspective view of the throat structure.
Figure 3:
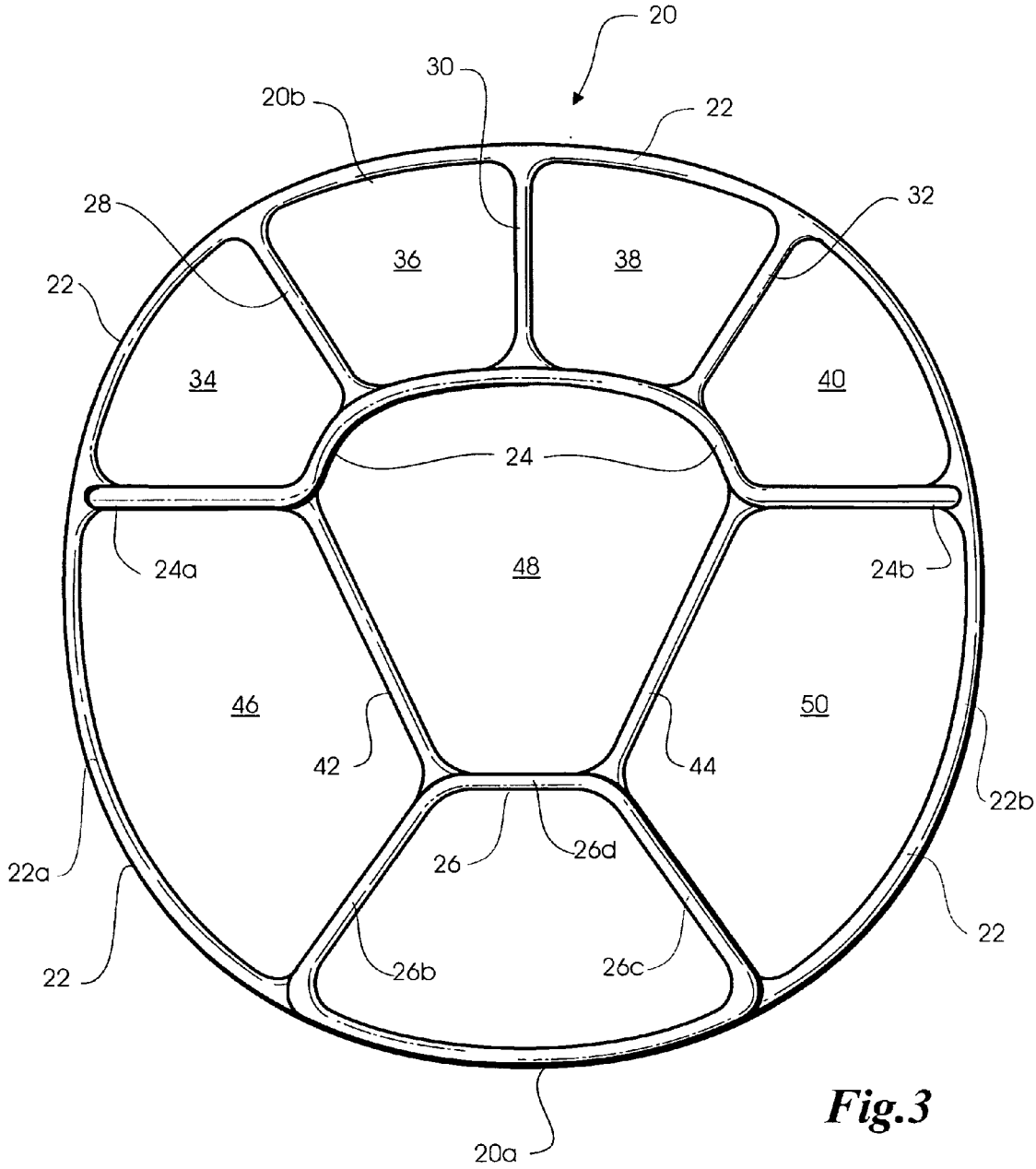
FIG. 3 is a top plan view of the throat structure.

Referring to FIG. 1, a golf bag 10 has a generally tubular body 12 with a top end 14 which is open and a bottom end 16 which is closed. Golf clubs may be inserted and removed from the golf bag 10 through the top end 14 of the body 12 in conventional manner.

Figure 4:
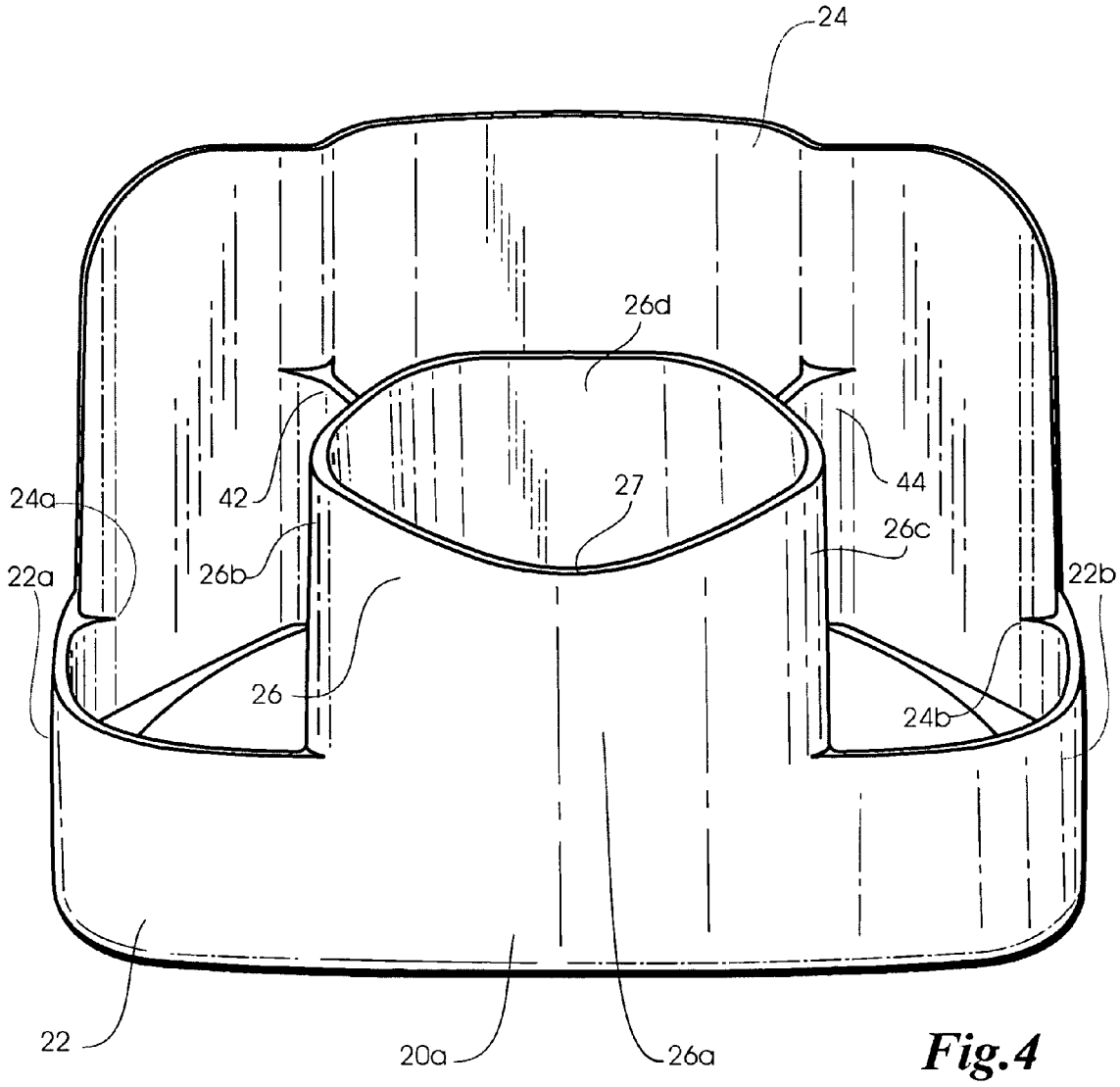
FIG. 4 is a front elevational view of the throat structure.
Figure 5:
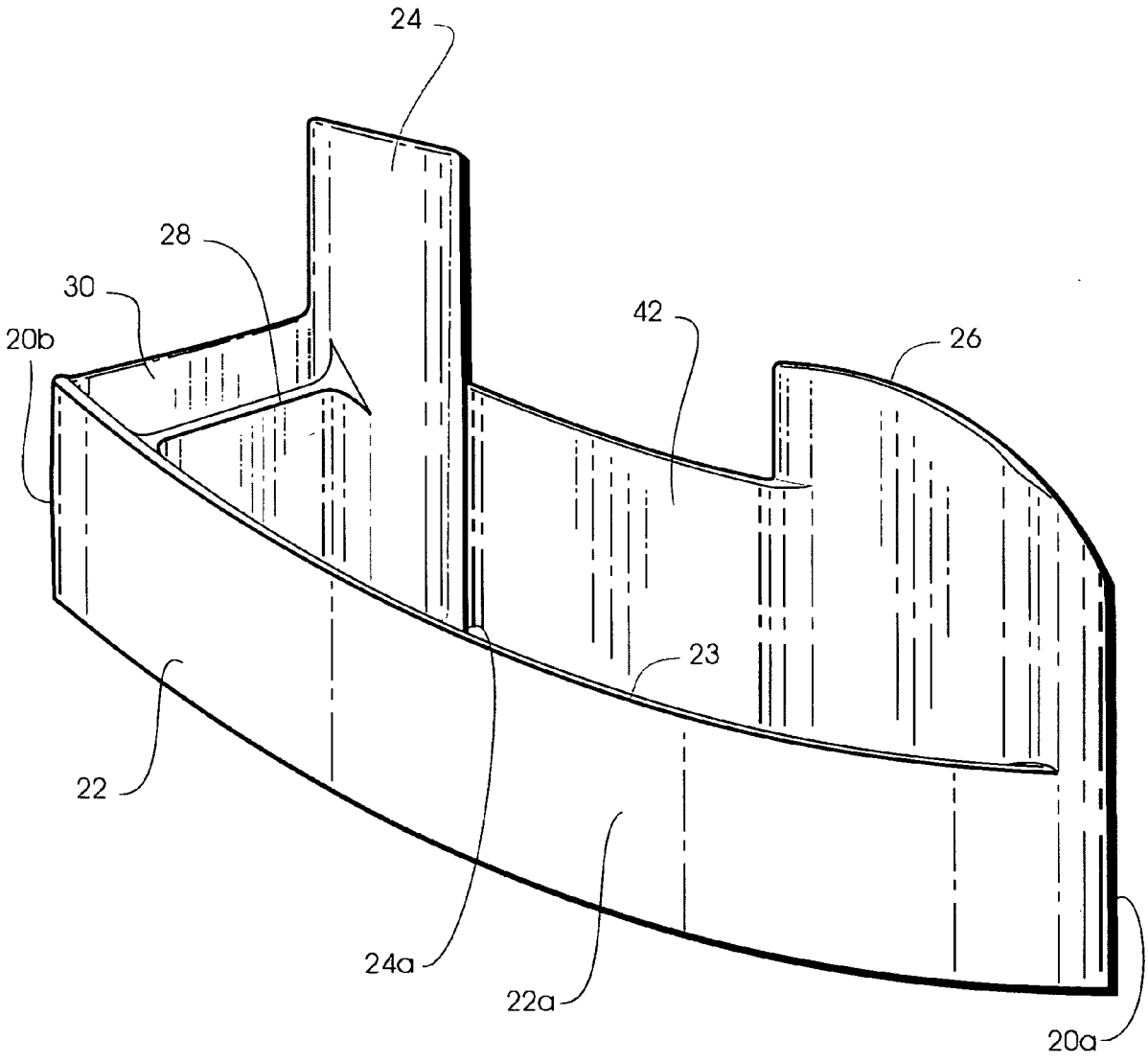
FIG. 5 is a side elevational view of the throat structure.

The top end 14 of the golf bag 10 is defined by a throat structure 20 mounted therein and which is also shown in FIGS. 2–5. The throat structure 20 includes a substantially ring-shaped outer wall 22 which is secured to the body 12 by well known means such as sewing or riveting. The throat structure 20 also includes a raised inner wall 24 extending transversely of the body top end 14. Opposite ends 24*a*, 24*b* of the raised inner wall 24 are connected to the outer wall 22. As best seen in FIG. 5, the outer wall 22 has an upper edge 23 that slopes upwardly from a front portion 20*a* to a back portion 20*b* of the throat structure 20.

A first plurality of divider walls 28, 30, 32 are connected between the outer wall 22 and the raised inner wall 24 to define a first plurality of four individual compartments 34, 36, 38, 40 located along the back portion 20*b* of the throat structure 20. The four individual compartments 34, 36, 38, 40 are each sized for receiving one wood-type golf club. Such wood-type golf clubs (not shown) would typically include a driver and three fairway woods, nos. 3, 4 and 5.

A raised well 26 is located along the front portion 20*a* of the throat structure 20 opposite the four individual compartments 34, 36, 38, 40. The raised well 26 is defined by a front wall 26*a*, opposite side walls 26*b*, 26*c* and a back wall 26*d*. The raised well 26 is designed to receive a golf putter (not shown) and has a substantially V-shaped trough 27 formed in a top edge of its front wall 26*a*. The V-shaped trough 27, as best seen in FIG. 4, aligns the golf putter in the raised well 26 generally centrally between the opposite side walls 26*b*, 26*c* of the raised well 26.

A second plurality of divider walls 42, 44 extend between the inner wall 24 and the raised well 26 to define a second plurality of three individual compartments 46, 48, 50 located between the front and back portions 20*a*, 20*b* of the throat structure 20. The three individual compartments 46, 48, 50 are each sized for receiving at least three iron-type golf clubs. Such iron-type golf clubs (not shown) would typically include nine irons, nos. 3 through 9, a sand wedge and a lob wedge.

The raised inner wall 24 has a height sufficient to prevent the iron-type golf clubs in the compartments 46, 48, 50 from contacting the wood-type golf clubs in the compartments 34,

36, 38, 40. The raised well 26 has a height which is sufficient to prevent the iron-type golf clubs in the compartments 46, 48, 50 from contacting the golf putter in the raised well 26. The alignment of the golf putter by the V-shaped trough 27 keeps the golf putter away from the iron-type golf clubs in the compartments 46, 48, 50. Also, since the side walls 26*b*, 26*c* and the back wall 26*d* of the raised well 26 are higher than the front wall 26*a*, the iron-type golf clubs in the compartments 46, 48, 50 will either swing over or be prevented from contacting the golf putter in the raised well 26.

It will be understood that the throat structure 20 will receive fourteen golf clubs including four woods with one wood in each of the compartments 34, 36, 38, 40, nine irons with three irons in each of the compartments 46, 48, 50, and one putter in the raised well 26. The divider walls 42, 44 are raised relative to side sections 22*a*, 22*b* of the outer wall 22. This causes the compartment 48 to be specially adapted for receiving the longer irons (such as nos. 3, 4 and 5) while making the compartments 46, 50 better suited for receiving the shorter irons (such as nos. 6, 7, 8, 9, sand wedge and lob wedge).

What is claimed is:

1. A throat structure for a golf bag wherein the golf bag includes a body with a top end and a bottom end, said throat structure being mounted in the top end of said body and comprising:

a substantially ring-shaped outer wall;

a raised inner wall extending generally transversely of the body top end and having its opposite ends connected to said outer wall;

a first plurality of divider walls extending between said inner and outer walls to define a first plurality of individual compartments located along a back portion of the throat structure each of which is adapted for receiving one wood-type golf club;

a raised well located along a front portion of the throat structure opposite said first plurality of individual compartments, said raised well being adapted for receiving a golf putter; and a second plurality of divider walls extending between said raised inner wall and said raised well to define a second plurality of individual compartments located between the front and back portions of the throat structure each of which is adapted for receiving a plurality of iron-type golf clubs.

2. The throat structure of claim 1, wherein said first plurality of divider walls comprises three divider walls, and wherein said first plurality of individual compartments comprises four individual compartments.

3. The throat structure of claim 1, wherein said second plurality of divider walls comprises two divider walls and wherein said second plurality of individual compartments comprises three individual compartments.

4. The throat structure of claim 1, wherein said outer wall has an upper edge that slopes upwardly from the front portion to the back portion of the throat structure.

5. The throat structure of claim 1, wherein said raised inner wall has a height sufficient to prevent the iron-type golf clubs received in the second plurality of individual compartments from contacting the wood-type golf clubs received in the first plurality of individual compartments.

6. The throat structure of claim 1, wherein said raised well has a height sufficient to prevent the iron-type golf clubs received in the second plurality of individual compartments from contacting the golf putter received in said raised well.

7. The throat stricture of claim 1, wherein said raised well includes a substantially V-shaped trough formed in a top edge of a front wall thereof for aligning the golf putter received in said raised well generally centrally between opposite side walls of said raised well.

8. The throat structure of claim 1, wherein:

said first plurality of divider walls comprises three divider walls, and wherein said first plurality of individual compartments comprises four individual compartments; and said second plurality of divider walls comprises two divider walls and wherein said second plurality of individual compartments comprises three individual compartments.

9. The throat structure of claim 1, wherein:

said raised inner wall has a height sufficient to prevent the iron-type golf clubs received in the second plurality of individual compartments from contacting the wood-type golf clubs received in the first plurality of individual compartments;

said raised well has a height sufficient to prevent the iron-type golf clubs received in the second plurality of individual compartments from contacting the golf putter received in said raised well; and said raised well includes a substantially V-shaped trough formed in a top edge of a front wall thereof for aligning the golf putter received in said raised well generally centrally between opposite side walls of said raised well.

* * * * *